US005722279A

United States Patent [19]

Ogawa et al.

[11] Patent Number: 5,722,279

[45] Date of Patent: Mar. 3, 1998

[54] CONTROL METHOD OF STRIP TRAVEL AND TANDEM STRIP ROLLING MILL

[75] Inventors: Shigeru Ogawa; Kenji Yamada; Atsushi Ishii, all of Futtsu; Hiroshi Omi, Tokyo; Takehiro Nakamoto, Oita, all of Japan

[73] Assignee: Nippon steel Corporation, Tokyo, Japan

[21] Appl. No.: 436,351

[22] PCT Filed: Sep. 14, 1994

[86] PCT No.: PCT/JP94/01522

§ 371 Date: Jul. 6, 1995

§ 102(e) Date: Jul. 6, 1995

[87] PCT Pub. No.: WO95/07776

PCT Pub. Date: Mar. 23, 1995

[30] Foreign Application Priority Data

Sep. 14, 1993 [JP] Japan ..... 5-229031

[51] Int. Cl.[6] ..... B21B 37/00

[52] U.S. Cl. ..... 72/11.4; 72/8.6; 72/12.3; 72/365.2

[58] Field of Search ..... 72/8.6, 8.7, 9.3, 72/11.4, 234, 365.2, 12.3, 205

[56] References Cited

U.S. PATENT DOCUMENTS

| | | | |
|---|---|---|---|
| 4,269,051 | 5/1981 | Clarke et al. | 72/8.7 |
| 4,674,309 | 6/1987 | Fabian et al. | 72/8.7 |
| 5,018,377 | 5/1991 | Lawson | 72/11.4 |
| 5,103,662 | 4/1992 | Fapiano | 72/8.6 |
| 5,172,579 | 12/1992 | Nojima | 72/8.7 |
| 5,404,738 | 4/1995 | Sekiguchi | 72/11.4 |
| 5,509,285 | 4/1996 | Anbe | 72/8.6 |

FOREIGN PATENT DOCUMENTS

| | | | |
|---|---|---|---|
| 60-234711 | 11/1985 | Japan | 72/8.6 |
| 62-244513 | 10/1987 | Japan | 72/8.6 |
| 63-188415 | 8/1988 | Japan | 72/8.6 |
| A4-4914 | 1/1992 | Japan . | |
| A4-37407 | 2/1992 | Japan . | |
| A4-91812 | 3/1992 | Japan . | |
| 5177229 | 7/1993 | Japan | 72/11.4 |

*Primary Examiner*—Lowell A. Larson
*Assistant Examiner*—Ed Tolan
*Attorney, Agent, or Firm*—Kenyon & Kenyon

[57] ABSTRACT

A control method of strip travel for ensuring, in a tandem rolling operation for metal strips, stable positioning of rolled work during the rolling process including the rolling of the leading and trailing ends of the work, and a tandem rolling mill in which the method is used are disclosed. In the control method of strip travel for the tandem strip rolling equipment comprising at least two roll stands and including between the roll stands a rolled work tension measuring device having independent tension detectors on both working and driving sides and a lateral position measuring device for measuring the lateral position of rolled work, the lateral position of the rolled work at the position of the rolled work tension measuring device is detected directly or estimated from an output of the lateral position measuring device, a tension difference representing the difference between tensions actually acting on the working and driving sides of the rolled work at the position of the rolled work tension measuring device is computed from the detected or estimated lateral position and the outputs of the working-side and driving-side detectors of the rolled work tension measuring device, and the difference between screwdown settings on the working and driving sides of each roll stand is controlled aiming at reducing the tension difference to zero.

9 Claims, 6 Drawing Sheets

CONTROL METHOD OF STRIP TRAVEL AND TANDEM STRIP ROLLING MILL

TECHNICAL FIELD

The present invention relates to an operation control method for ensuring stable positioning of rolled work during the rolling process in a tandem rolling operation for metal strips, and also relates to a tandem rolling mill in which the method is used.

BACKGROUND ART

Tandem rolling of metal strips is a process capable of mass-producing high-precision light-gauge metal strips. Since tension can be applied to rolled work between roll stands constituting a tandem rolling mill, the tandem rolling process provides a very stable rolling operation. When tension is applied to rolled work, if the difference in screwdown settings between the working and driving sides (hereinafter referred to as the screwdown leveling) deviates somewhat from an optimum value, for example, such deviation usually does not directly lead to strip side-tracking since the difference does not directly result in a difference in elongation but the difference in elongation between the working side and the driving side is suppressed because of a redistribution of the tension.

At the leading and trailing ends of the rolled work, however, since backward or forward tension cannot be applied, the stabilizing effect mentioned above is reduced by half, increasing the possibility of strip side-tracking. In particular, backward tension has such a significant effect that strip side-tracking known as tail crash is likely to occur when the trailing end passes a roller at which the backward tension is released. To prevent this, screwdown swiveling control, called strip travel control, has been practiced in the prior art. In the description hereinafter given, a shortened term "left and right" will often be used to refer to the working side and driving side. Further, in this specification, sideways excursions of rolled work from the mill center will be referred to as "strip travel".

It is believed that the primary cause for tail crashes is the strip travel caused by the difference in elongation, between left and right, near the trailing end of the rolled work. In the prior art method of strip travel control, control of the difference in screwdown settings between left and right of the roll stand concerned (leveling control) is started from the moment that the phenomenon of tail crash is to begin to show, that is, the moment that the trailing end of the rolled work has exited the preceding roll stand. This control is performed by detecting the difference in rolling loads between left and right of the roll stand concerned or by using a detection signal or the like representing the work's off-center amount detected by a strip travel sensor.

In the above strip travel control of the prior art, since control is, in effect, started when the trailing end of the rolled work has exited the preceding roll stand, the operating time for control is short and the control may not be in time to prevent a tail crash. Furthermore, if there is a deviation from an optimum value in the screwdown leveling of the roll stand concerned, strip travel occurs at the moment that the trailing end of the work exits the preceding roll stand, since the backward tension that has been acting on the rolled work is released and the compensating effect provided by the difference in tension between left and right is lost. If the screwdown leveling control is performed after such a symptom has appeared, it is often too late to correct the situation.

DISCLOSURE OF THE INVENTION

Accordingly, the invention discloses a method of maintaining the screwdown leveling of each roll stand in a tandem rolling mill in an optimum condition by starting control while in a steady-state rolling condition before the trailing end of rolled work exits the preceding roll stand, not after that, and also discloses a tandem rolling mill for implementing the method.

The greatest change that occurs when the trailing end of rolled work exits the preceding roll stand is, needless to say, the loss of backward tension. Accordingly, if abrupt strip travel begins at this instant in time, a reasonable guess is that the screwdown leveling of the roll stand concerned was side the optimum value and the deviation was compensated for by the difference in backward tension between left and right. It is therefore reasonable to assume that the problem of tail crash can be effectively prevented by bringing the difference between the left and right tensions, acting on the rolled work between roll stands, as close to zero as possible while in a steady-state condition before the trailing end of the work exits. What is needed to achieve this is to detect the difference between the left and right tensions acting on the rolled work between the roll stands and to perform an operation to bring the difference close to zero.

To achieve this, according to a first aspect of the invention, there is provided a control method of strip travel for a tandem strip rolling mill comprising at least two roll stands and including between the roll stands a rolled work tension measuring device having independent tension detectors on both working and driving sides and a lateral position measuring device for measuring the lateral position of rolled work, characterized in that the lateral position of the rolled work at the position of the rolled work tension measuring device is detected directly or estimated from an output of the lateral position measuring device, the tension difference representing the difference between tensions actually acting on the working and driving sides of the rolled work at the position of the rolled work tension measuring device is computed from the detected or estimated lateral position and outputs of the working-side and driving-side detectors of the rolled work tension measuring device, and the difference between screwdown settings on the working and driving sides of each roll stand is controlled aiming at reducing the tension difference to zero.

Furthermore, to effectively implement the control method of strip travel, there is provided, according to a second aspect of the invention, a tandem strip rolling mill comprising at least four roll stands and including a rolled work tension measuring device and a rolled work lateral position measuring device located upstream of each of at least two consecutive roll stands in the downstream end of the mill, characterized in that the rolled work tension measuring device is equipped with independent tension detectors on both working and driving sides. Also, according to a third aspect of the invention, there is provided a tandem strip rolling mill comprising at least two roll stands, characterized in that a rolled work tension measuring device, having independent tension detectors on both working and driving sides, and detecting devices, capable of detecting the lateral position of the rolled work on both upstream and downstream sides of the rolled work tension measuring device between the roll stands, are provided in at least one inter-stand position.

BEST MODE FOR CARRYING OUT THE INVENTION

Figure 1:
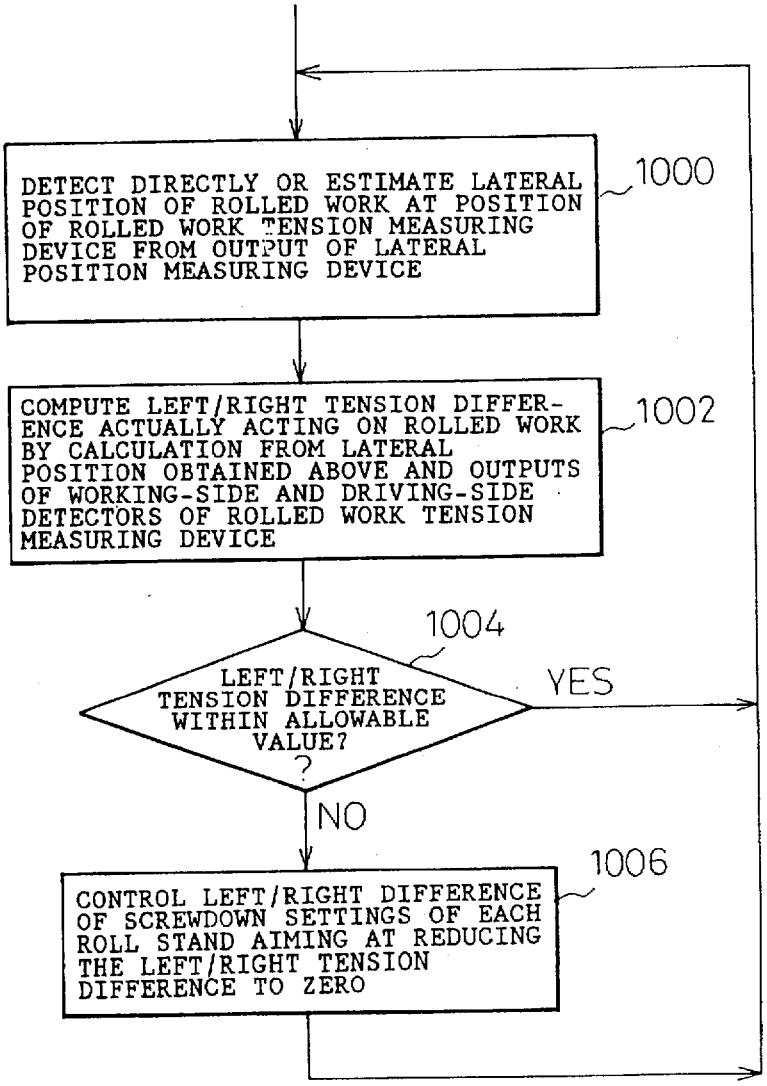
FIG. 1 is a diagram illustrating an algorithm for a control method of strip travel according to one embodiment of the present invention.

FIG. 1 is a flowchart illustrating a control method of strip travel according to one embodiment of the present invention. In step 1000, the lateral position of rolled work at the position of a rolled work tension measuring device provided between roll stands is detected directly or estimated by interpolation, using an output of a lateral position measuring device which is provided to measure the lateral position of the rolled work between the roll stands. In step 1002, the left/right difference of the tension actually acting on the rolled work is computed from the lateral position obtained in the above step and the outputs of detectors at the working side and driving side of the rolled work tension measuring device. In step 1004, it is determined whether the thus computed left/right tension difference is within an allowable value; if the difference is within the allowable value, the process returns to step 1000. Otherwise, the process proceeds to step 1006, where the difference between the screw-down settings at the left and right of each roll stand is controlled aiming at reducing the left/right tension difference to zero, after which the process returns to step 1000.

Figure 2:
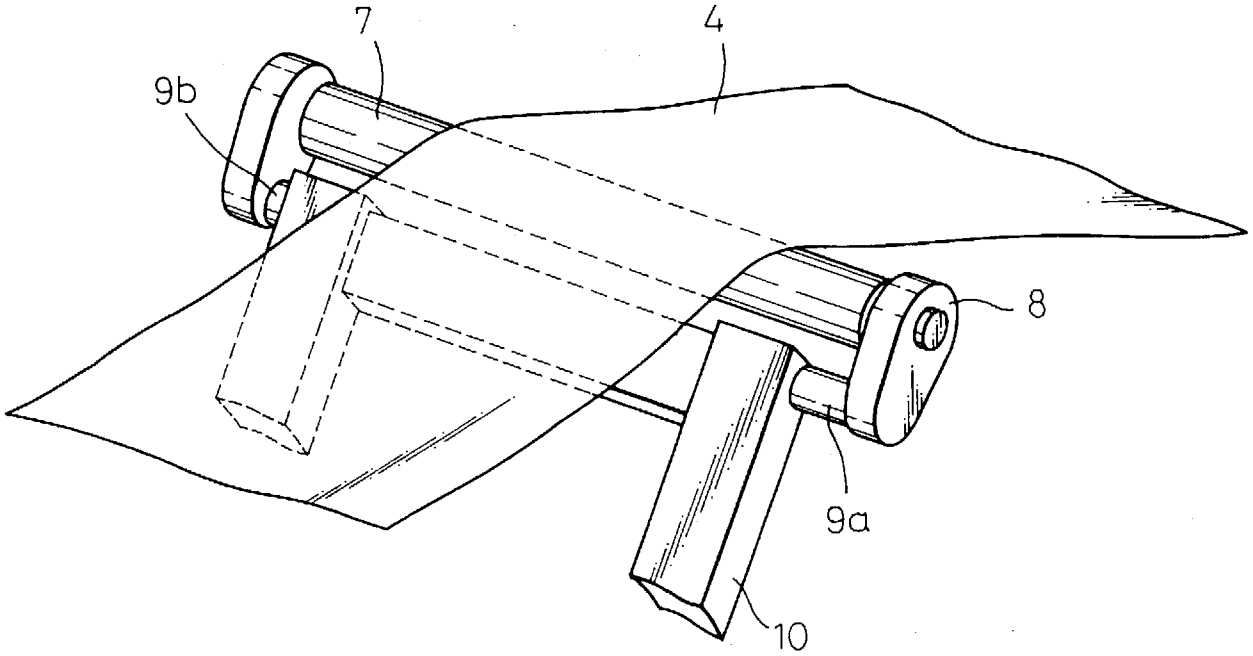
FIG. 2 is a schematic diagram of a looper-type tension detecting device as an example of a rolled work tension measuring device having independent tension detectors on both working and driving sides, an essential requirement of the present invention.
Figure 3:
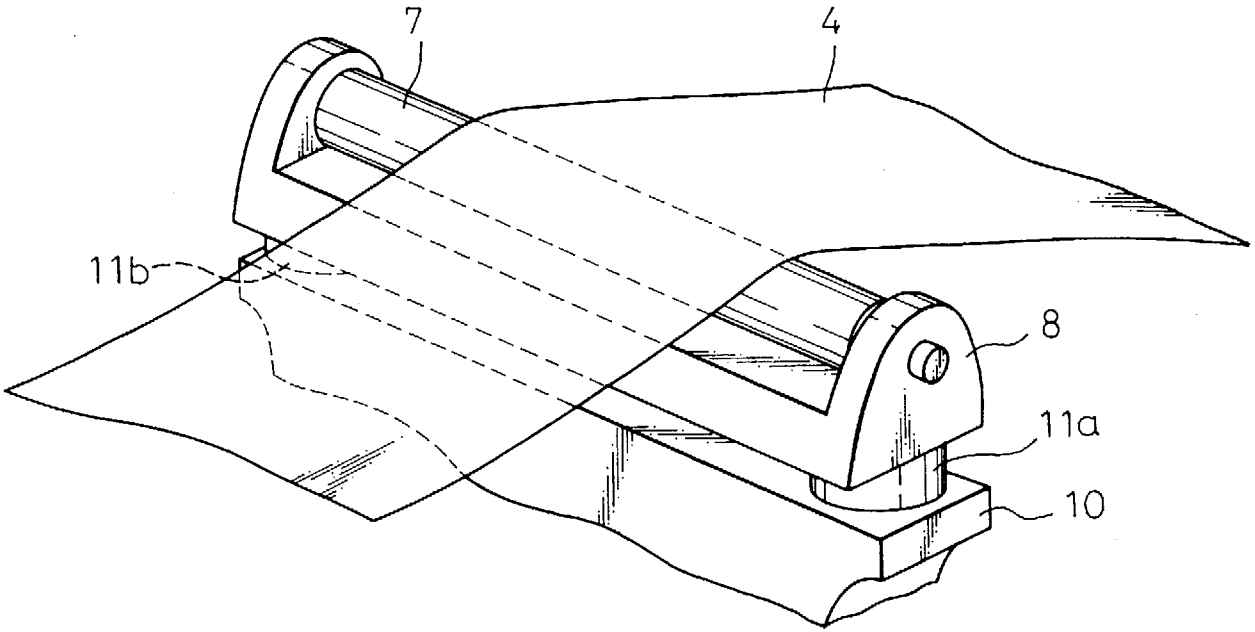
FIG. 3 is a schematic diagram of a semi-fixed type tension detecting device as an example of a rolled work tension measuring device having independent tension detectors on both working and driving sides an essential requirement of the present invention.

The rolled work tension measuring device is, for example, a vertically movable looper device, as shown in FIG. 2, which is primarily used in hot rolling, or an essentially fixed tension detection roll, as shown in FIG. 3, which is primarily used in cold rolling. In this device, the force acting on an idle roller 7 by the tension being exerted on rolled work 4 is detected by torsion bar-type load cells 9*a* and 9*b* or load cells 11*a* and 11*b*. The present invention is based on the premise that the load cells are provided independently of each other on the working and driving sides, as shown in FIG. 2 or 3; by observing the difference between their outputs, asymmetric components (with respect to the working and driving sides) of the force acting on the rolled work tension measuring device can be extracted. To convert the load cell outputs into the tension acting on the rolled work, the angle that the rolled work 4 makes with a horizontal plane is calculated from the position of the idle roller 7 of the tension measuring device and the working roll position of the roll stand, and the tension is computed by calculation from the geometrical equilibrium conditions of the force vector. On the other hand, as the lateral position measuring device for the rolled work, an optical type is the most practical.

Considering rolled work passing between arbitrary roll stands No. i and No. i+1, a description will be given in further detail below by taking the looper-type tension measuring device of FIG. 2 as an example. When the load cell loads in the rolled work tension measuring device are converted to the loads in the perpendicular direction by taking the looper angle into account, and the difference between the loads on the working and driving sides is extracted and denoted as $R_{dfi}$, the value $R_{dfi}$ includes the effects of not only the tension difference $d_{dfi}$ but the lateral position of the rolled work, i.e. the work off-center amount $x_{oi}$, and the relation as expressed by the following equation holds.

$$R_{dfi}=[\{b^2/(6a_{Li})\}\sigma_{dfi}+(2/a_{Li})\sigma_i bx_{ci}](\sin\theta_{bi}+\sin\theta_{fi})h_i \quad (1)$$

where $a_{Li}$ is the distance between supporting points of the looper roll, $\theta_{bi}$ and $\theta_{fi}$ are the angles that the rolled strip surfaces on the i-th and (i+1)-th stands make with the horizontal plane with the looper roll therebetween, $h_i$ is the strip thickness at he exit of the i-th stand, $x_{ci}$ is the work off-center amount at the looper position, $\sigma_i$ is the tension per unit cross-sectional area of the rolled work (hereinafter referred to as the unit tension), and b is the width of the rolled work.

When $R_{dfi}$ is measured, if the work off-center amount at the looper position, $x_{ci}$, is unknown, it is not possible to accurately obtain the tension acting on the rolled work from equation (1). Generally, rolling operation is performed aiming at bringing $x_{ci}$ to zero, but in reality, an error of about 10 to 20 mm occurs, and this error can have an appreciable effect on the estimation accuracy of the tension $\sigma_{dfi}$ acting on the rolled work. For example, when $x_{ci}$=10 mm, $a_{Li}$=2000 mm, and b=1000 mm, if the tension difference $\sigma_{dfi}$ is estimated by disregarding the effect of $x_{ci}$ when evaluating the terms within the square brackets on the right-hand side of equation (1), there occurs an error equivalent to 12% of the unit tension $\sigma_i$. When rolling leveling control is performed in order to reduce the left/right tension difference $\sigma_{dfi}$ acting on the rolled work to zero, usually the work off-center amount $x_{ci}$ will also vary, but if the control were performed without detecting this variation, the control would entail a substantial error of ±0.12 $\sigma_i$ with respect to the target value $d_{dfi}$, making it impossible to perform satisfactory strip travel control that can ensure the prevention of tail crash. It is apparent that what is important to the prevention of strip side-tracking is not to reduce $R_{dfi}$ to zero, but to reduce $\sigma_{dfi}$ to zero.

From the above description, it is clear that to accurately detect $\sigma_{dfi}$ and perform control to bring $\sigma_{dfi}$ to zero, it is essential that a rolled work tension measuring device having independent tension detectors on both the working and driving sides be used and the difference between the loads at left and right acting on the tension measuring device be detected, and also that the lateral position of the rolled work at the position of the tension measuring device be detected directly or be estimated by computation.

Next, rolling equipment for implementing the above-described strip travel control will be described. Generally, in a tandem rolling mill, tail crash is most likely to occur at roll stands at the downstream side of the mill. This is because, since the strip thickness is reduced as the work is transported downstream, if the rolling leveling contains an error with respect to the optimum value, the effect of this error on the difference in elongation between left and right becomes relatively large, and also because, since the rolling speed increases in the downstream side, there is not enough time to perform control in a manual operation or in the prior art control method that starts rolling leveling control after the trailing end of the rolled work has passed the preceding stand.

Figure 4:
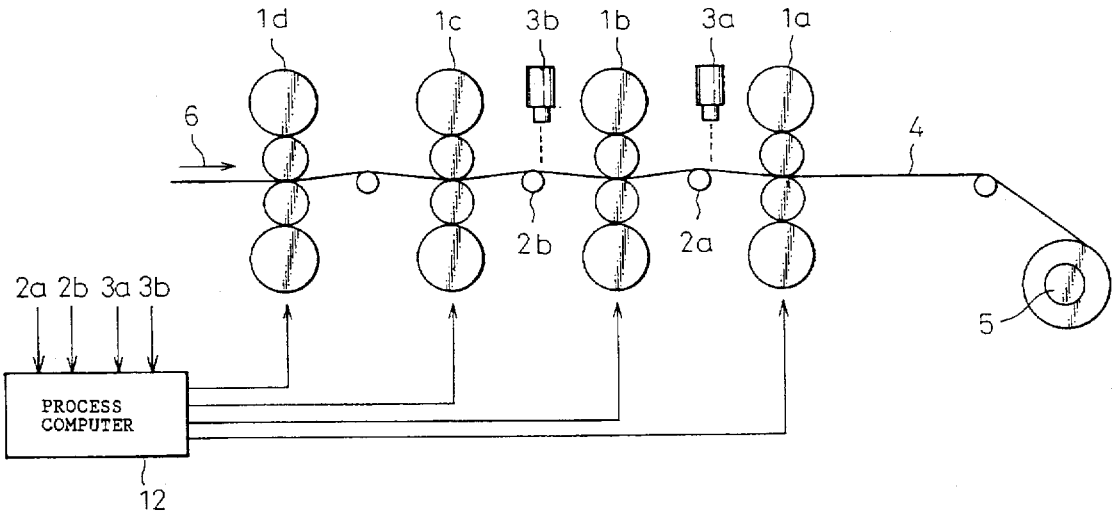
FIG. 4 is a schematic diagram showing an example of a tandem strip rolling mill according to another embodiment of the present invention.

To overcome this problem, a tandem strip rolling mill according to another embodiment of the invention comprises at least four roll stands and includes a rolled work tension measuring device and a rolled work lateral position measuring device located upstream of each of two consecutive roll stands in the downstream end of the mill, the rolled work tension measuring device being equipped with independent tension detectors on both the working and driving sides. These measuring devices are provided on the upstream side of each of the two roll stands in the downstream end because tail crash is most likely to occur there, as described above, and also because, in the rolling operation among these upstream roll stands, the plate thickness is substantially large and it is possible up to a certain point to forcefully restrict the work off-center amount by means of a guide provided on the upstream side of each roll stand, so that in equation (1), $x_{ci}$ can be safely assumed to be zero without causing a substantial error. That is, by providing rolled work tension measuring devices 2*a*, 2*b* and rolled work lateral position measuring devices 3*a*, 3*b* on the upstream side of at least two consecutive roll stands 1*a*, 1*b* in the downstream end, as shown in FIG. 4, substantially effective strip travel control is made possible. A process computer 12 accepts outputs from the rolled work tension measuring devices 2*a*, 2*b* and rolled work lateral position measuring devices 3*a*, 3*b*, carries out the earlier described calculations to compute the tension differences acting on the rolled work at respective positions between the roll stands, and controls the difference between the screwdown settings on the working and driving sides of each of the roll stands 1*a*, 1*b*, 1*c*, and 1*d*, in such a manner as to reduce the tension differences to zero.

To measure the lateral position of the rolled work at the position of the rolled work tension measuring device, the lateral edges of the rolled work must be detected at positions where the work is in contact with the idle roller 7 shown in FIG. 2 or 3, however, using optical means, it is often difficult to distinguish the strip edges from the idle roller itself. Accordingly, in the example shown in FIG. 4, the lateral position is measured at a position slightly downstream of the tension measuring device, from which the lateral position at the position of the tension measuring device is estimated. This method, however, inevitably introduces a certain degree of error in the estimation of the lateral position.

Figure 5:
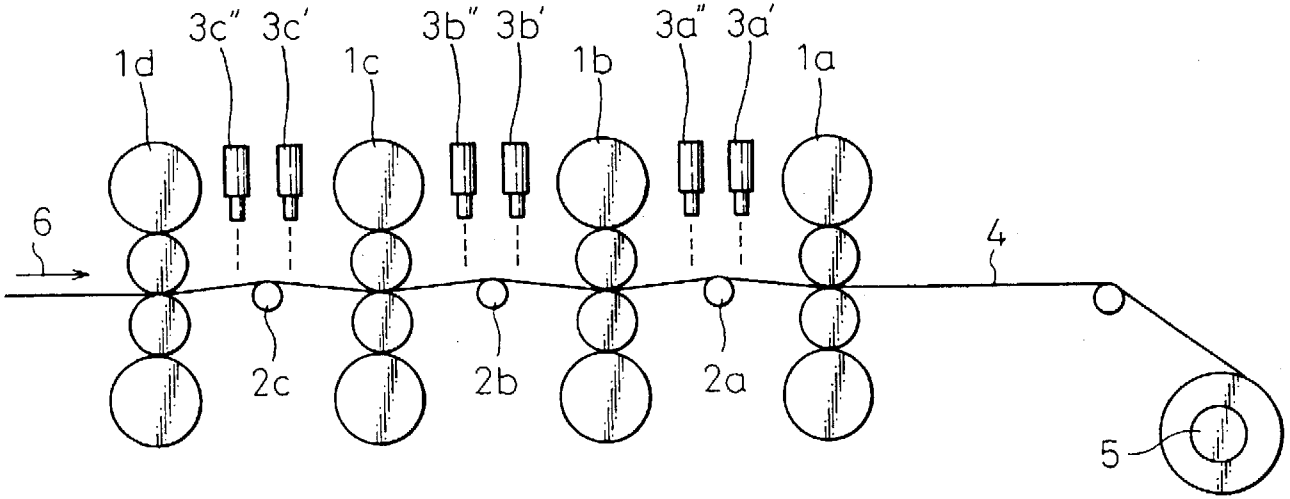
FIG. 5 is a schematic diagram showing an example of a tandem strip rolling mill according to a further embodiment of the present invention.

Accordingly, in a tandem strip rolling mill according to a further embodiment of the invention, lateral position measuring devices, 3*a*'/3*a*", 3*b*'/3*b*", and 3*c*'/3*c*", are disposed before and after rolled work tension measuring devices, 2*a*, 2*b*, and 2*c*, respectively, as shown in FIG. 5. With the lateral position measuring devices thus positioned on both the upstream and downstream sides of each rolled work tension measuring device, the lateral position of the rolled work at the position of the rolled work tension measuring device where direct measurement is difficult can be accurately estimated by interpolation from the outputs of the lateral position measuring devices located before and after that position. This increases the accuracy in estimating the tension difference acting on the rolled work, as a result of which the strip travel control according to the first aspect of the invention can be performed with high precision.

Figure 6:
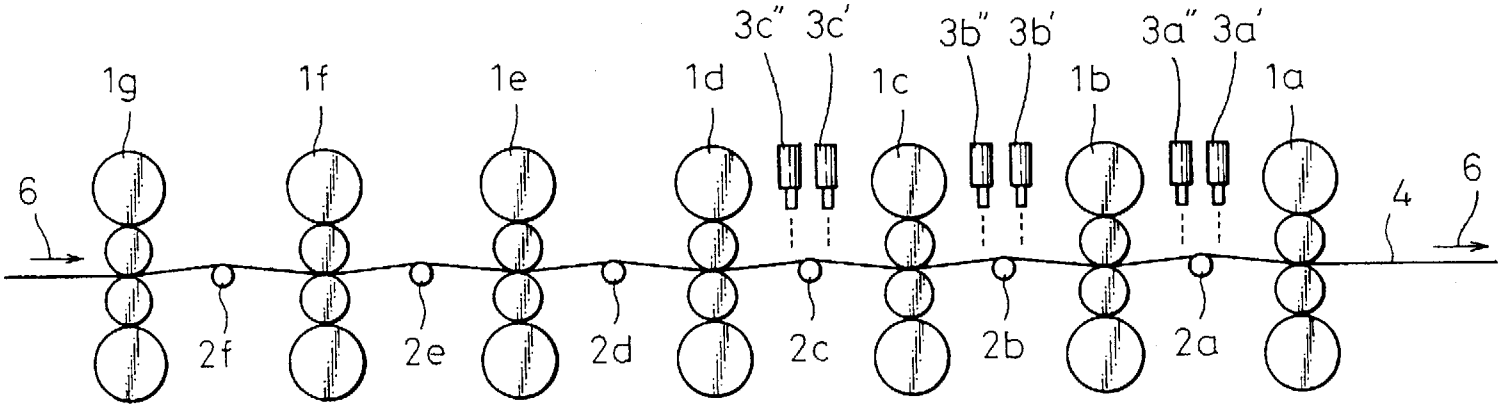
FIG. 6 is a schematic diagram showing an example of a tandem strip rolling mill according to the present invention.

FIG. 6 shows a seven-stand tandem mill, in which rolled work tension measuring devices, 2*a*–2*f*, each equipped with independent tension detectors on both the working and driving sides, are disposed alternately between the seven stands, and further, detector pairs, 3*a*'/3*a*", 3*b*'/3*b*", and 3*c*'/3*c*", each pair capable of detecting the lateral position of the rolled work on both the downstream and upstream sides of the corresponding rolled work tension measuring device, are located alternately between the three consecutive stands in the downstream end. Using this tandem rolling mill configuration, strip travel control was performed.

First, using only the outputs of the rolled work tension measuring devices and assuming the work off-center amount to be always zero, the tension difference $\sigma_{dfi}$ acting on the rolled work between the stands was estimated, and rolling leveling control was performed aiming at reducing $\sigma_{dfi}$ to zero. The result was that the lateral movement of the trailing end of the rolled work could not be brought into a fully stabilized condition.

Next, using such data as load cell and screwdown settings of each roll stand in addition to the outputs of the rolled work tension measuring devices, equations expressing various phenomena in tandem rolling were solved to estimate the work off-center amount directly under each roll, by interpolation from which the work off-center amount $x_{ci}$ at the position of each rolled work tension measuring device was computed, and the tension difference $\sigma_{dfi}$ acting on the rolled work was estimated using equation (1). With these conditions, rolling leveling control was performed aiming at reducing $\sigma_{dfi}$ to zero. The result was improved, compared to the first-mentioned control in which the work off-center amount was assumed to be zero, but the lateral movement of the trailing end of the rolled work, especially at the stands in the downstream side, could not be brought into a fully stabilized condition.

Finally, the work off-center amounts were directly detected using the detector pairs, 3*a*'/3*a*", 3*b*'/3*b*", and 3*c*'/3*c*", each pair capable of detecting the lateral position of the rolled work on both the downstream and upstream sides of the corresponding rolled work tension measuring device, and the work off-center amount at the position of each rolled work tension measuring device was computed by interpolation from the outputs of the detectors located before and after that position; then, the tension difference $\sigma_{dfi}$ acting on the rolled work was estimated using the interpolated value and equation (1). With these conditions, rolling leveling control was performed for each stand, aiming at reducing $\sigma_{dfi}$ to zero. The result showed a dramatic improvement in the estimation accuracy of the tension difference acting on the rolled work at the downstream-side stands where tail crash is particularly a problem, and the lateral movement of the trailing end of the rolled work could be brought into an almost fully stabilized condition.

As described above, according to the control method of strip travel and the tandem strip rolling mill of the invention, the tension difference acting on the rolled work between the roll stands in the tandem rolling mill can be controlled to almost zero during the steady-state operation of rolling. This substantially eliminates strip side-tracking in every process of the rolling operation including the rolling of the trailing end of the rolled work, achieving a dramatic improvement in productivity and production yield.

We claim:

1. A control method of strip travel for a tandem strip rolling mill comprising at least two roll stands and including between said roll stands a rolled work tension measuring device having independent tension detectors on both working and driving sides and a lateral position measuring device for measuring the lateral position of rolled work, characterized in that the lateral position of the rolled work at the position of said rolled work tension measuring device is detected directly or estimated from an output of said lateral position measuring device, the tension difference representing the difference between tensions actually acting on the working and driving sides of the rolled work at the position of said rolled work tension measuring device is computed from said detected or estimated lateral position and outputs of the working-side and driving-side detectors of said rolled work tension measuring device, and the difference between screwdown settings on the working and driving sides of each of at least the roll stands on the upstream and downstream sides of said rolled work tension measuring device, is controlled aiming at reducing said tension difference to zero, regardless of the lateral position of said rolled work.

2. A tandem strip rolling mill comprising at least four roll stands and including a rolled work tension measuring device and a rolled work lateral position measuring device located upstream of each of at least two consecutive rolling mills in the downstream end of said mill, characterized in that said rolled work tension measuring device is equipped with independent tension detectors on both working and driving sides, and that said rolled work lateral position measuring device is capable of detecting the rolled work lateral position in the vicinity of said rolled work tension measuring device or is capable of estimating the rolled work lateral position at the exact longitudinal position of said rolled work tension measuring device.

3. A tandem strip rolling mill comprising at least two roll stands, characterized in that a rolled work tension measuring device, having independent tension detectors on both working and driving sides, and a detecting device, capable of detecting the lateral position of rolled work on both upstream and downstream sides of said rolled work tension measuring device between said roll stands, and capable of estimating the rolled work lateral position at the exact longitudinal position of said rolled work tension measuring device, are provided in at least one inter-stand position.

4. A control method of strip travel comprising the steps of:

(a) installing, in at least one inter-stand position in a tandem strip rolling mill, a rolled work tension measuring device having a working-side and a driving-side detector;

(b) determining the lateral position of said rolled work at the position of said rolled work tension measuring device;

(c) computing the tension difference representing the difference between tensions acting on the working and driving sides of said rolled work between said roll stands, based on said lateral position and on outputs of the working-side and driving-side detectors of said rolled work tension measuring device; and (d) controlling the difference between screwdown settings on the working and driving sides of each of at least the roll stands on the upstream and downstream sides of said rolled work tension measuring device, aiming at reducing said tension difference to zero, regardless of said lateral position.

5. A method according to claim 4, wherein in step (b) the lateral position of said rolled work is determined by detecting the lateral position using a lateral position measuring device provided in the vicinity of said rolled work tension measuring device.

6. A method according to claim 4, wherein in step (b) the lateral position of said rolled work is determined by interpolation from lateral positions detected by lateral position measuring devices provided on upstream and downstream sides of said rolled work tension measuring device.

7. A control apparatus for strip travel comprising:

means provided in at least one inter-stand position in a tandem strip rolling mill for measuring rolled work tension and having a working-side and a driving-side detector;

means for determining the lateral position of said rolled work at the position of said rolled work tension measuring means;

means for computing a tension difference representing the difference between tensions acting on the working and driving sides of said rolled work between said roll stands, based on said lateral position and on the outputs of the working-side and driving-side detectors of said rolled work tension measuring means; and means for controlling the difference between screwdown settings on the working and driving sides of each of at least the roll stands on the upstream and downstream sides of said rolled work tension measuring means, aiming at reducing said tension difference to zero, regardless of said lateral position.

8. An apparatus according to claim 7, wherein said lateral position determining means includes a lateral position measuring device provided in the vicinity of said rolled work tension measuring means.

9. An apparatus according to claim 7, wherein said lateral position determining means includes lateral position measuring devices provided on upstream and downstream sides of said rolled work tension measuring means, and means for performing interpolation from lateral positions detected by said lateral position measuring devices.

* * * * *

UNITED STATES PATENT AND TRADEMARK OFFICE

CERTIFICATE OF CORRECTION

PATENT NO. : 5,722,279

DATED : March 3, 1998

INVENTOR(S) : Shigeru OGAWA, et al.

It is certified that error appears in the above-indentified patent and that said Letters Patent is hereby corrected as shown below:

Title page, 73 , change "Nippon steel" to --Nippon Steel--.

Column 2, line 10, change "side" to --outside--.

Column 3, line 7, after "sides" insert a comma.

Column 4, line 5, change "$^{d}$dfi" to --$\sigma$dfi--.

Column 4, line 7, change "$^{X}$oi" to --$^{X}$ci--.

Column 4, line 15, change "he" to --the--.

Signed and Sealed this

Eleventh Day of August 1998

Bruce Lehman

*Attest:*

BRUCE LEHMAN

*Attesting Officer*

*Commissioner of Patents and Trademarks*